US006450386B1

(12) United States Patent
Hessberger et al.

(10) Patent No.: US 6,450,386 B1
(45) Date of Patent: Sep. 17, 2002

(54) CHAIN DRAWING MACHINE FOR CONTINUOUS DRAWING OF DRAWING STOCK

(75) Inventors: Dirk Hessberger, Aachen (DE); Bruno Walczak, Aachen (DE)

(73) Assignee: Schumag AG, Aachen (DE)

( * ) Notice: Subject to any disclaimer, the term of this patent is extended or adjusted under 35 U.S.C. 154(b) by 0 days.

(21) Appl. No.: 09/679,788

(22) Filed: Oct. 5, 2000

(30) Foreign Application Priority Data

Oct. 5, 1999 (DE) ..... 199 47 806

(51) Int. Cl.[7] ..... B65H 20/00; B25B 25/00
(52) U.S. Cl. ..... 226/172; 140/123.5
(58) Field of Search ..... 226/172, 173, 226/190; 140/123.5

(56) References Cited

U.S. PATENT DOCUMENTS

| | | | | | |
|---|---|---|---|---|---|
| 2,868,356 | A | * | 1/1959 | Haaff | 226/172 X |
| 3,045,886 | A | * | 7/1962 | Francis et al. | 226/172 |
| 3,945,547 | A | * | 3/1976 | Ledebur | 226/172 |
| 4,034,904 | A | * | 7/1977 | Juditzki | 226/172 X |
| 4,655,291 | A | * | 4/1987 | Cox | 226/172 X |
| 5,326,010 | A | * | 7/1994 | Moras | 226/172 |
| 5,775,417 | A | * | 7/1998 | Council | 226/172 X |
| 6,173,769 | B1 | * | 1/2001 | Goode | 226/173 X |

FOREIGN PATENT DOCUMENTS

| | | |
|---|---|---|
| DE | 197 11 101 C1 | 4/1998 |
| EP | 0 254 028 A | 1/1988 |
| EP | 0 548 723 B2 | 4/1998 |

* cited by examiner

*Primary Examiner*—Michael R. Mansen
(74) *Attorney, Agent, or Firm*—Henry M. Feiereisen

(57) ABSTRACT

A chain drawing machine for continuous drawing of drawing stock made of metal and the like, in particular rod-shaped and tubular drawing stock, includes at least two drive chains associated with a common drawing path. Each of the drive chains has connected drawing members, with the drawing members having on one side a clamping shoe that can be pressed against the drawing stock, and on the other side a sliding surface. The drawing members are supported on a fixed roller guide that is associated with each driving chain, and on the sliding surface by rotating load-bearing idler rollers. At least one relief recess divides a respective roller guide into several guide paths; and at least one relief recess divides a respective sliding surface into several sliding paths. This arrangement, in conjunction with a circumferential taper in the idler rollers extending across the entire sliding surface, elastically supports the drive chains which increases of the load-bearing capacity of the machine.

24 Claims, 6 Drawing Sheets

CHAIN DRAWING MACHINE FOR CONTINUOUS DRAWING OF DRAWING STOCK

CROSS-REFERENCES TO RELATED APPLICATIONS

This application claims the priority of German Patent Application Ser. No. 199 47 806.6, filed Oct. 5, 1999, the subject matter of which is incorporated herein by reference.

BACKGROUND OF THE INVENTION

The present invention relates to a chain drawing machine for continuous drawing of drawing stock, in particular of rod-shaped and tubular drawing stock. More particularly, the invention relates to a chain drawing machine with at least two drive chains and drawing members that have on one side a clamping shoe that can be pressed against the drawing stock, and on the other side a sliding surface which supports the drawing members via a rotating load-bearing idler rollers on a fixed roller guide associated with each driving chain.

Drawing stock that is made of metal and continuously drawn with a chain drawing machine is typically clamped between clamping shoes on a drawing path. The clamping shoes are moved in the drawing direction by continuously revolving drawing chains that are driven by chain wheels. To support the pressing forces without friction, the drive chains move on a plurality of load bearing idler rollers which also revolve continuously about fixed tracks or stationary roller guides. The drawing stock is clamped along the drawing path by clamping shoes disposed on at least two drive chains, with the clamping shoes being supported by corresponding roller guides and idler rollers disposed on the machine. When two drive chains are used, the roller guide are arranged in parallel on both sides of the drawing path. Other types of drawing machines can have several drive chains with clamping shoes that can optionally press symmetrically or asymmetrically against the drawing stock.

EP 0 548 723 B2 discloses a chain drawing machine of this type. The drawing members of the drive chains have on their backside, i.e., on the side facing away from the clamping shoes, a sliding surface that—much like a roller bearing—runs over a moving chain that is guided on a stationary rigid roller guide consisting of the idler rollers. The clamping force is transferred directly through the idler rollers from the clamping shoes via the sliding surface to the roller guide. To achieve a stable machine construction and to compensate for the tilt of the guide rollers which tend to rotate out of alignment when an uneven force is applied, the guide rollers are arranged in the center. All sliding surfaces of the linearly arranged drawing members have a single sliding surface which is located opposite the rigid roller guide and extends over the same width as the idler rollers and the roller guide. The arrangement the contact surface in the center between the idler rollers and the sliding surface of the drawing members and the roller guide disposed on the machine, respectively, is intended to accurately introduce and/or distribute the force over the machine frame for minimizing wear of the idler rollers. The individual drawing members are connected with one another through bolts and include a complex arrangement of additional idler rollers and safety plates with matching geometrical dimensions.

SUMMARY OF THE INVENTION

It is thus an object of the present invention to provide an improved chain drawing machine, obviating the afore-stated drawbacks.

In particular, it is an object of the present invention to provide an improved chain drawing machine that has a simpler construction and supports large clamping forces.

The invention relates to a chain drawing machine for continuous drawing of drawing stock with at least two drive chains associated with a common drawing path. Each of the drive chains has drawing members that are connected with one another and can be driven by means provided laterally on the drawing members. A clamping shoe that can be pressed against the drawing stock is disposed on one side of the drawing members, with a sliding surface disposed on the other side of the drawing members. The sliding surface supports the drawing members via a rotating load-bearing idler rollers on a fixed roller guide associated with each driving chain.

According to one aspect of the invention, the idler rollers interact with the sliding surface and/or the roller guide via a segmented contact surface and are guided at the height of the segmented contact surface only by guides that travel with the rollers. This arrangement obviates the need for a complex guide arrangement on the sliding surface and/or the roller guide, and hence significantly reduces the manufacturing costs. This arrangement also simplifies maintenance of the machine since a stationary guide or a guide that travels with the drawing members, is difficult to access.

According to another aspect of the invention, the roller guides for the drive chains can be separated into guide paths by a least one relief recess. Because the roller guides on which the idler rollers roll, are subject to manufacturing tolerances and are also not completely flat, the relief recess can provide a better fit between the idler rollers and the roller guide and thus increase the effective contact line or contact surface that supports the force.

Advantageously, the sliding plane of the drawing members can also be separated into sliding paths by providing at least one relief recess. It is particularly advantageous if the idler rollers are formed so as to be able to slightly yield resiliently relative to the entire width of all guide paths and sliding paths, for the purpose of adapting to the tolerances that may exist in the guide paths and sliding paths.

According to a first embodiment, the idler rollers extend across at least two guide paths, preferably each idler roller across all guide paths. Advantageously, the idler rollers have a circumferential taper associated with a respective relief recess for better adapting the idler rollers to the existing tolerances. Depending on the location of the relief recesses, the idler rollers are thereby intentionally weakened and/or their diameter is reduced in order to resiliently adapt and/or bend within certain limits across their width to compensate for tolerances in the guide paths and sliding surfaces.

According to another embodiment of the invention, the idler rollers are composed of two parallel guided sets of track rollers, wherein each guide path and/or sliding path is associated with one set of the track rollers. Mechanical guiding of the idler rollers and/or the sets of track rollers can be facilitated by connecting the sets of track rollers with one another through track roller cages or by implementing the sets of track rollers in form of chains.

The force can be distributed more evenly by placing the guide paths and the sliding paths opposite of each other uniformly and/or with an identical width. Moreover, at least one relief recess advantageously divides the roller guide and/or the sliding surface in the center. According to another advantageous embodiment of the invention, two guide paths and/or two sliding paths can be provided.

In addition, the drawing members may be connected with one another with a connecting bolt, wherein track rollers and/or tie elements are arranged on both sides of the drawing members on the connecting bolt. The force can be introduced and distributed more uniformly if the clamping shoes and the sliding surfaces are located on opposite, mutually parallel sides of the drawing members, wherein the clamping shoes and the sliding surfaces and/or sliding paths can be integrated with the drawing members to form a single piece.

According to another advantageous embodiment of the invention, the idler rollers are formed of at least two roller sections which are supported on a common axle. This arrangement is particularly cost-effective and can be implemented using standard building blocks while maintaining the same advantages as the aforedescribed embodiments. Preferably, a spacer, for example a sleeve disposed on the axle, can be placed between the roller sections.

In this embodiment, the idler rollers can advantageously be connected with one another in the form of a chain. Since the plates of the chain partially overlap, bending of the chain in the lateral direction is limited. This provides a simple outer guide for the idler rollers and/or the roller sections. The outer guide can absorb guide forces acting in the lateral direction.

Advantageously, the inner guide elements can absorb guide forces acting in the lateral direction. The inner guide elements travel with the rollers, are disposed at the same height as the contact surface separation, and do not come in lateral force-transmitting contact with stationary guide elements. Because the inner guide elements themselves can absorb the guide forces, inner components, such as stationary guide elements, become unnecessary. Eliminating the stationary guide elements frees up space and enables a more compact construction.

The laterally acting guide forces are to be understood as including those forces that include a force component acting in an imaginary plane that extends perpendicular to the guide plane.

The costs for design, manufacturing and subsequent maintenance also be advantageously reduced by eliminating the stationary guide elements.

Advantageously, the inner guide elements are arranged parallel to the sliding surface as well as between the sliding surface and the guide surface.

The inner guide elements are also present in the embodiment where the idler rollers consist, for example, of parallel guided sets of track rollers. This also obviates the need for stationary lateral components to guide the idler rollers.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
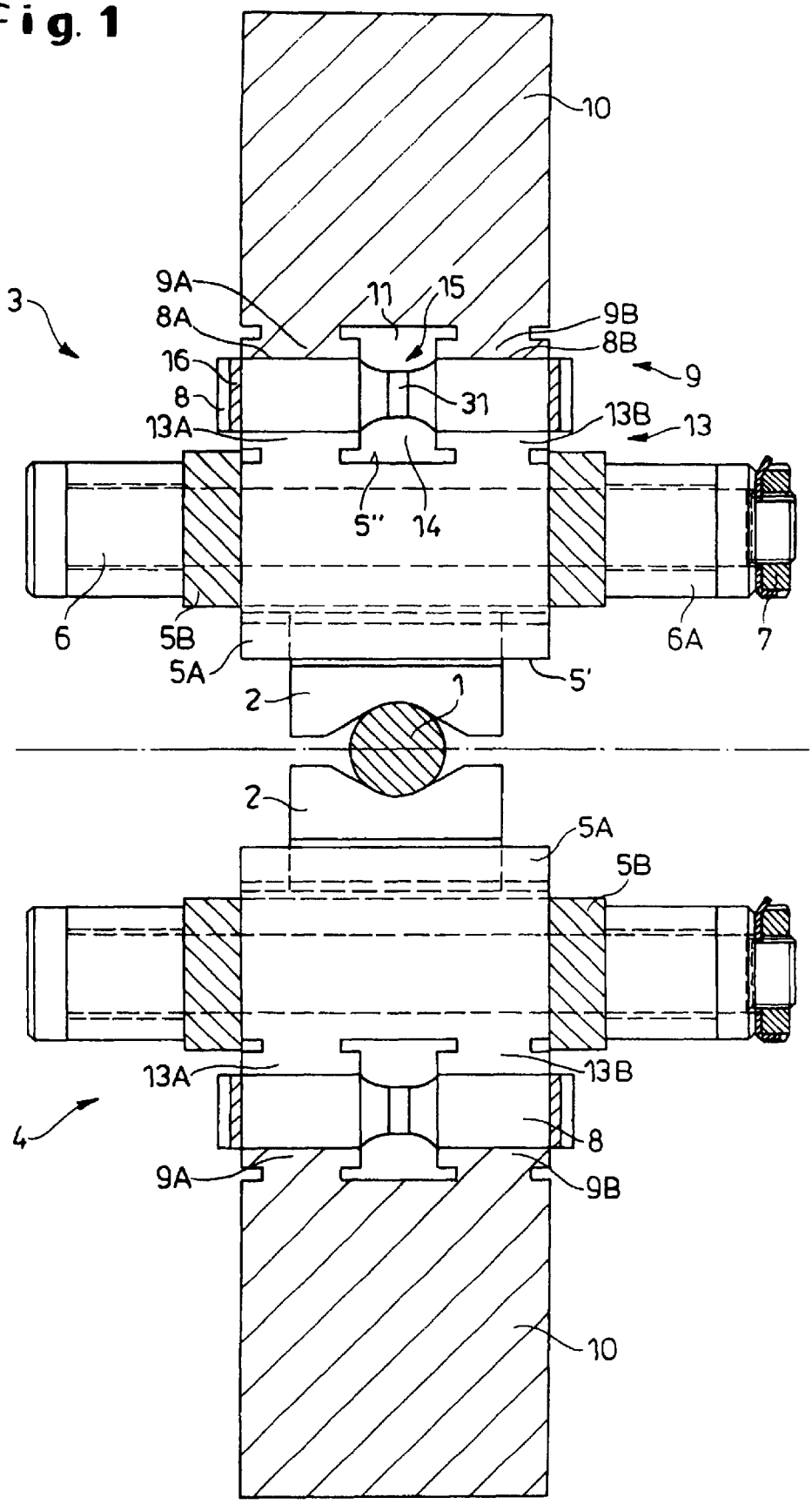
FIG 1. shows schematically a first embodiment of a drive chain guide for a chain drawing machine according to the invention.

Throughout all the Figures, same or corresponding elements are generally indicated by same reference numerals.

Turning now to the drawing, and in particular to FIG. 1, there is shown a basic concept of a drive chain guide of a chain drawing machine (not shown). The drawing stock 1 is clamped between the clamping shoes 2 of a continuous revolving upper drive chain 3 and a continuous revolving lower drive chain 4. Each of the drive chains 3, 4 consists of several identically formed drawing members 5A, 5B that are connected with each other through a connecting bolt 6. The clamping shoes 2 are arranged on the outside 5' of the drawing members 5A, 5B relative to the circular path of the drive chains 3, 4. The connection between the drawing members 5A, 5B is secured with nuts 7.

The chain drawing machine has spaced-apart chain wheels (not shown in FIG. 1; see FIG. 5) that drive the drive chains 3, 4. The teeth of the chain wheels can cooperate with the connecting bolts 6 either directly or via the drawing members 5A. Preferably, two spaced apart chain wheels are provided for each drive chain 3, 4, with the drive chains 3, 4 traveling between and around the chain wheels. This arrangement provides a drive which is located to the side of the drawing members.

Along a drawing path, the drive chains 3, 4 are supported by idler rollers 8. Also along the drawing path, the clamping shoes 2 are pressed against the drawing stock 1 by a rigid guide surface 9 that is disposed on the machine frame 10. The guide surface 9 has in the center a relief recess 11 which separates the guide surface 9 into a first guide path 9A and a second guide path 9B. Rolling contact between the idler rollers 8 and the drawing members 5A, 5B is provided by a sliding face 13 that is divided by a relief recess 14 into a first sliding path 13A and a second sliding path 13B. The sliding face 13 is located on the inside 5" of the drawing members 5A, 5B that face the clamping shoes 2, i.e., on the side that is parallel and opposite to the outside 5'.

To optimally match the idler rollers 8 to the tolerances of the guide planes 9 and the sliding planes 13, respectively, the continuous idler roller 8 which preferably extends at least over the width of the two guide paths 9A, 9B and the two sliding paths 13A, 13B, has a circumferential taper 15 in the form of a groove and the like. The circumferential taper 15 allows the idler roller 8 to bend elastically and thereby keep the sections 8A, 8B flat to optimally contact the guide paths 9A, 9B and/or the sliding paths 13A, 13B. In this way, the entire width of the sections 8A, 8B is available as a support surface for the drawing members 5A, 5B. The increased elasticity in the support of the drive chains 3, 4 provided by the circumferential paper 15 and the relief recesses 11, 14 increases the load-bearing capacity and the actual load of the entire chain drawing machine. The idler rollers 8 can be implemented in form of individual rollers disposed in special guides or, as described above, in form of roller chains connected with plates 16. Since the plates 16 partially overlap proximate to the connecting bolts 6, the plates limit lateral bending of the roller chain and partially compensate the laterally acting guide forces. The plates 16 here take on the role of a direct outer guide. The special guides mentioned above can be implemented as inner guide elements 31 that can absorb the laterally acting guide forces and hence maintain the position of the idler rollers 18 in a predetermined region of the guide paths 9A, 9B. This obviates the need for stationary guide elements arranged between the sliding surface 13 and the guide surface 9.

It will be understood that the illustrated shapes and dimensions of the relief recesses 11, 14, of the guide paths 9A, 9B, the sliding paths 13A, 13B, and the circumferential taper 15 is for illustrative and exemplary purposes only. The shapes and dimensions can be optimized and adapted to the overall design of the machine. The relief recesses 11,14 and the circumferential taper 15 as well as the guide paths 9A, 9B and the sliding paths 13A, 13B can preferably be implemented, as illustrated, with an identical width.

Figure 2:
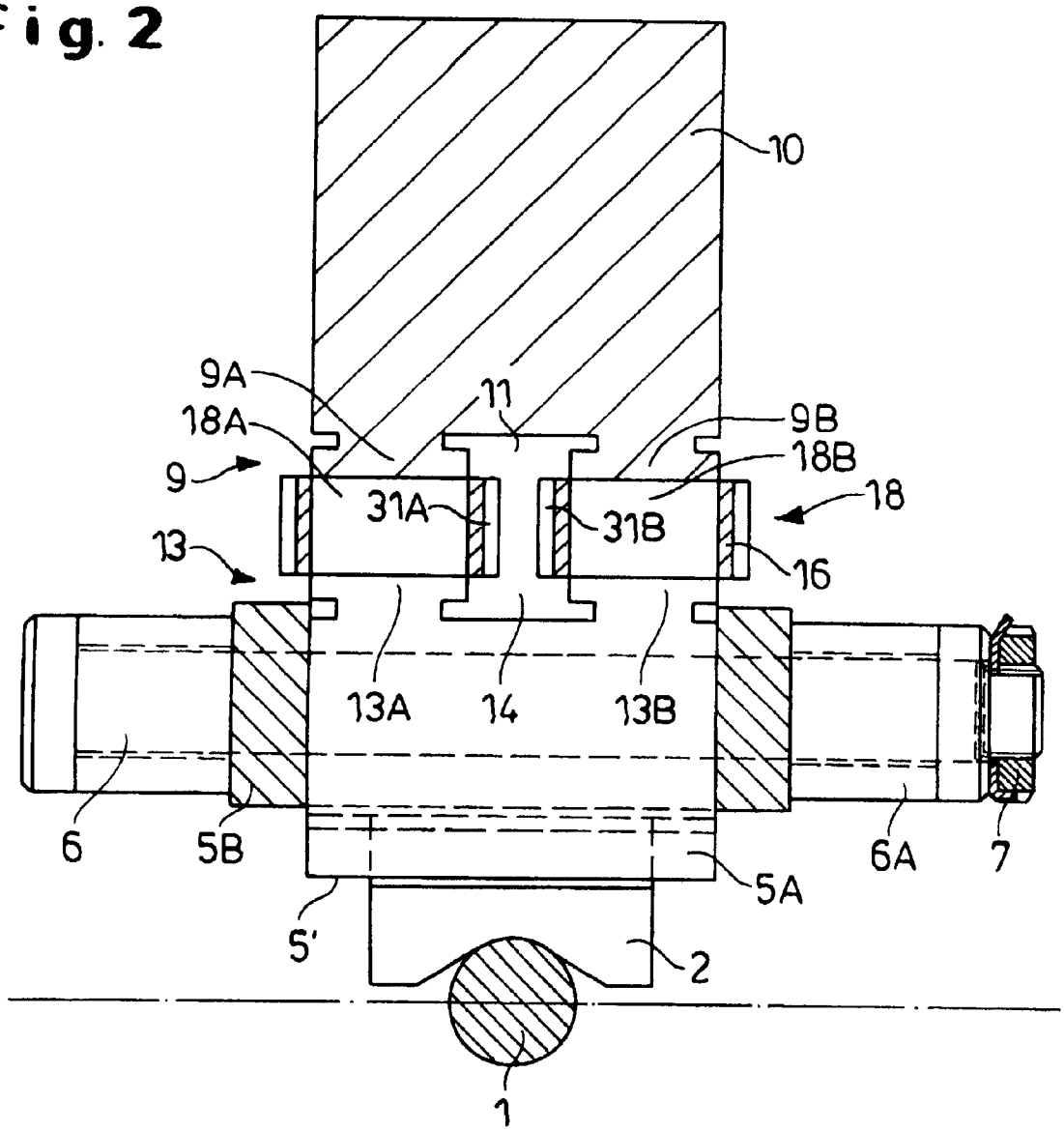
FIG. 2 shows schematically the top portion of a second embodiment of a drive chain guide for a chain drawing machine according to the invention.

FIG. 2 shows only the upper half of a second embodiment. Identical elements and elements performing an identical function are indicated with the same reference numerals. The idler rollers 18 of FIG. 2 are designed differently from those depicted in FIG. 1. The idler rollers 18 here consists of two sets of track rollers 18A, 18B, i.e., of individual idler rollers that are distributed over the guide surface and slide surface, respectively. The first set of track rollers 18A is associated with the guide paths 9A and sliding paths 13A, wherein the second set of track rollers 18B is associated with the guide paths 9B and sliding paths 13B. The sets of track rollers 18A, 18B can be connected with one another, for example, through roller cages (not shown). Alternatively or in addition, the idler rollers 18 of the respective sets of track rollers can be connected with one another through plates 16, as illustrated in FIG. 2. The plates 16 may also represent a direct outer guide, since the plates are capable of absorbing laterally acting guide forces. The inner guide elements 31A, 31B can also absorb laterally acting guide forces, so that stationary guide elements can also be eliminated in the second embodiment, while still having the chain drawing machine operate reliably along the drawing path.

Figure 3:
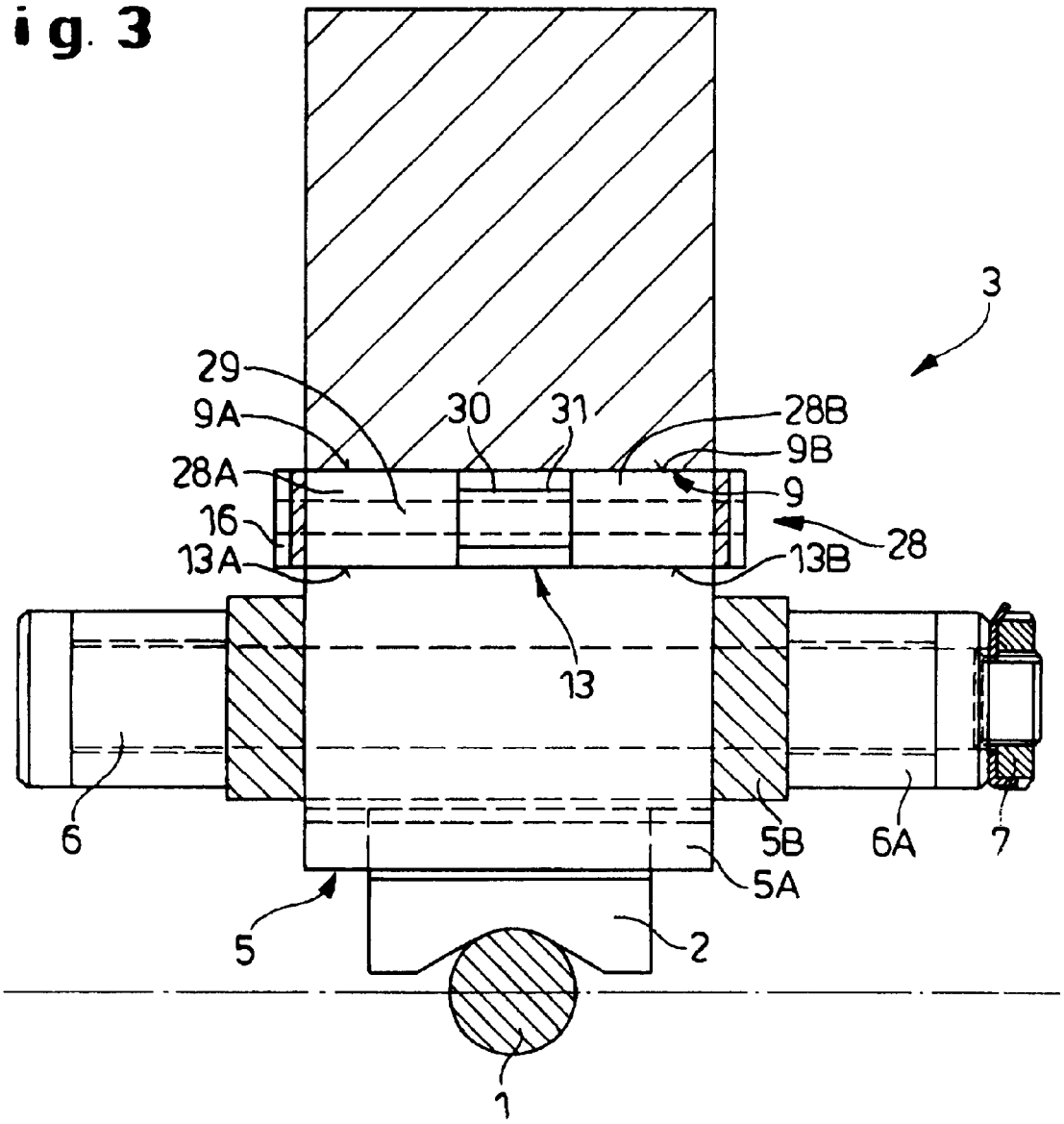
FIG. 3 shows schematically the top portion of a third embodiment of a drive chain guide for a chain drawing machine according to the invention.

In the third embodiment illustrated in FIG. 3, the idler rollers 28 have two roller sections 28A, 28B arranged on an axle 29. In addition, a spacer 30 which aids in guiding the idler rollers 28, is arranged on the axle 29 between the roller sections 28A, 28B.

The third embodiment does not include a relief recess, the spacer 30 disposed between the roller sections allows the idler rollers to adapt and flex. The spacer 30 also operates as an inner guide element 31. The third embodiment also does not include any stationary guide elements since the inner guide elements 31 can absorb laterally acting guide forces. Moreover, the idler rollers are here connected with one another by lateral plates 16 which directly provide the outer guiding.

Figure 4:
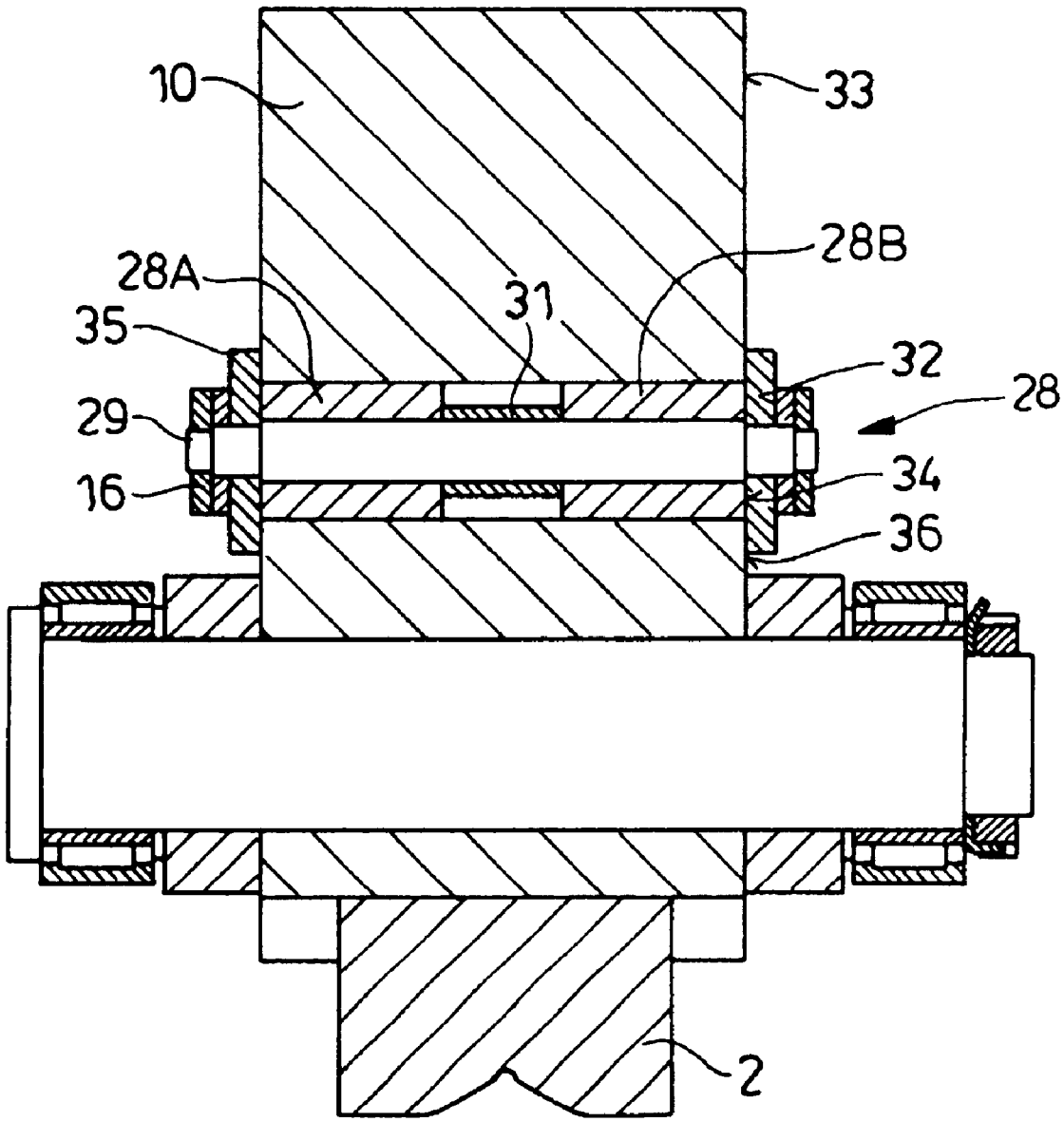
FIG. 4 shows schematically a fourth embodiment of a drive chain guide according to the invention.

In a fourth embodiment illustrated in FIG. 4, the idler rollers 28 once again include two roller sections 28A, 28B arranged on an axle 29. As in the third embodiment of FIG. 3, an inner guide element 31 is disposed between the two roller sections 28A, 28B. Likewise, the guide rollers 28 are again implemented as roller chains connected by lateral plates 16. A guide plate 35 is disposed between the surface 32 of the plates 16 which is located inwards on the side of the idler rollers, and the opposing surfaces 33 (lateral surface of the machine frame 10) and 34 (outer lateral surface of the idler rollers 28). The guide plate 35 is made of a low-friction material and holds the tools in a preferred position. In this embodiment, the inner upper region of the guide plate 35 slides on the lateral surface 33 of the machine frame 10, whereas the lower inner region of the guide plate 35 slides on the lateral surface 36 of the drawing members 5. The outer lateral region of the guide plate 35 is in partial contact with the lateral plate 16. As a result, the guide plates 35 experience a very small pulling force or no pulling force at all.

Figure 5A:
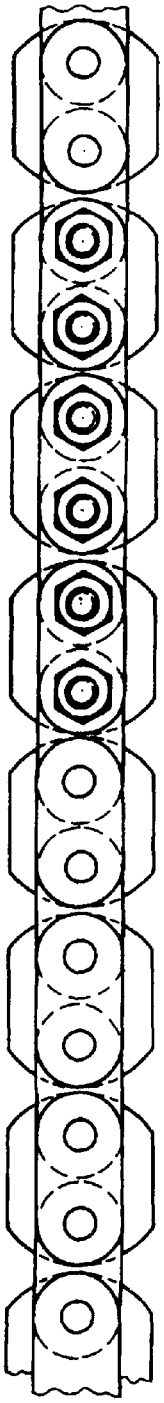
FIGS. 5*a*–5*c* show a plan, side and sectional views of a roller cage for interconnecting roller sections.
Figure 5B:
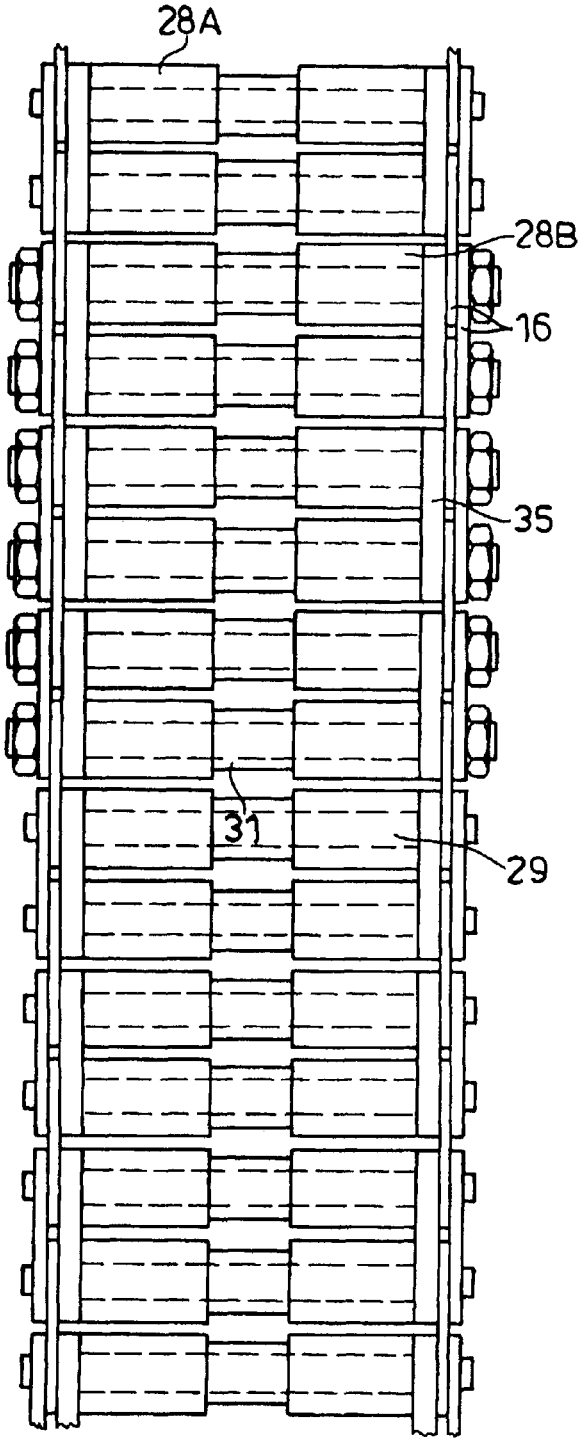
Figure 5C:
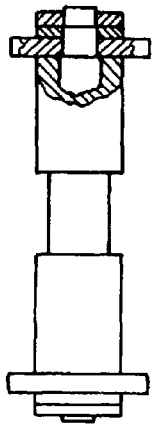

FIGS. 5*a* to 5*c* show by way of example the connection of the roller sections 28A, 28B with one another by means of through roller cages. Parts corresponding with those in FIG. 4 are denoted by identical reference numerals and not explained again. The roller cage is comprised of the guide plates 35 for supporting the axle 29 upon which the roller sections 28A, 28B are mounted and the inner guide elements 31.

Figure 6:
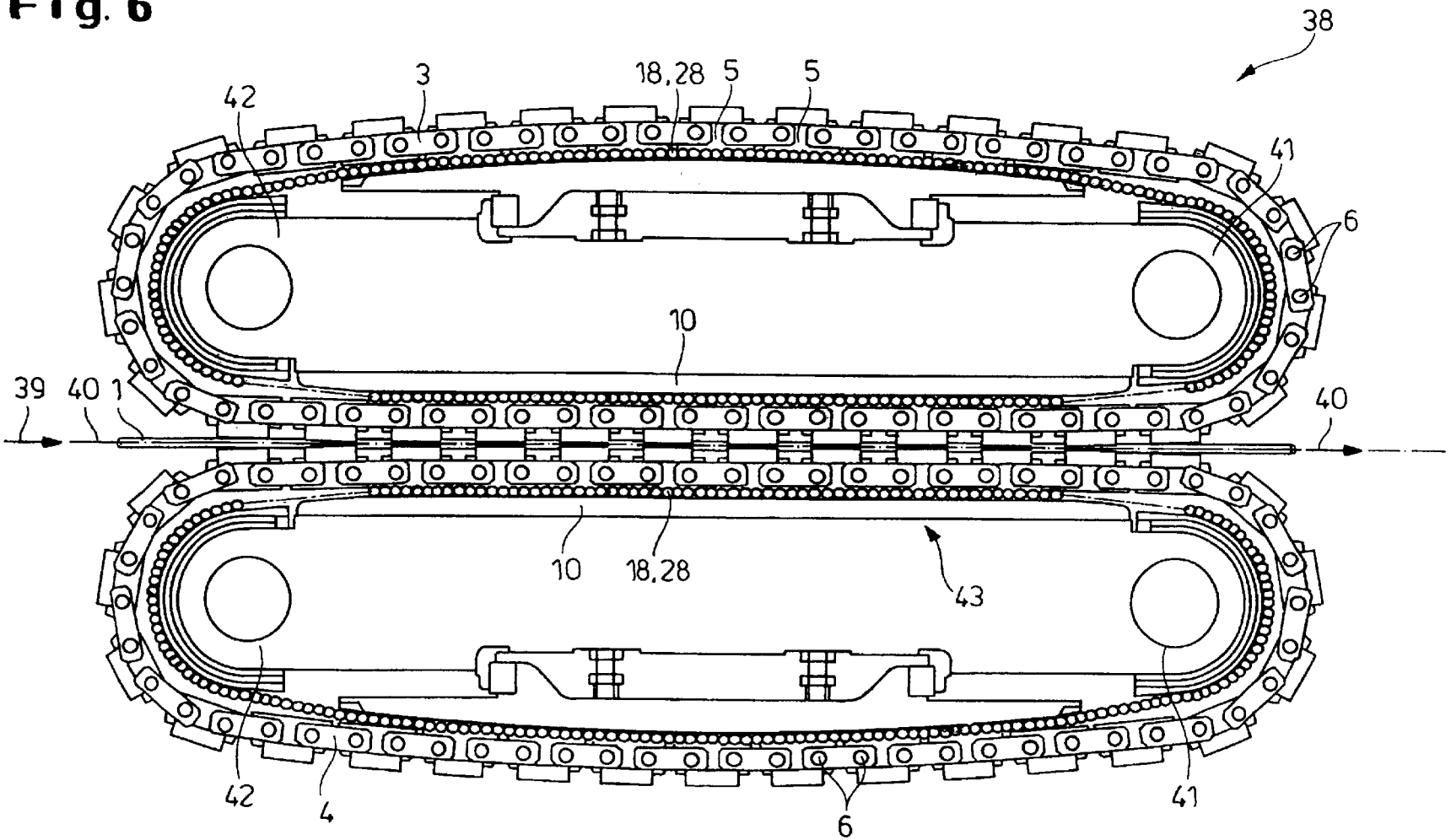
FIG. 6 shows a longitudinal cross-section of a chain drawing machine to illustrate the operating principle of the chain drawing machine.

FIG. 6 shows a longitudinal section of a chain drawing machine 38 with a continuously revolving upper drive chain 3 and a continuously revolving lower drive chain 4. At the height of a center axis 39, the tools and/or the drawing members of the two drive chains 3, 4 converge so as to transport the drawing stock 1 through the chain drawing machine 38 from left to right in the direction of the arrow 40. Each of the drive chains runs over two chain wheels 41, 42, with one of the chain wheels operating as a drive wheel. The teeth of the chain wheels 41, 42 engage with the spaces between the connecting bolts 6 and thereby cooperate with the connecting bolts 6 of the drive chains 3, 4. Idler rollers 18, 28 are arranged between the drawing members 5 and the machine frame 10. The idler rollers 18, 28 are in rolling contact with the drawing members and the machine frame 10 particularly in the working region 43 and transfer the pressure forces produced in the working region 43 to the machine frame 10.

While the invention has been disclosed in connection with the preferred embodiments shown and described in detail, various modifications and improvements thereon will become readily apparent to those skilled in the art, without departing in any way from the spirit of the present invention. For example, the drawings depict two guide paths and two sliding paths. However, more than two guide paths and sliding paths as well as more than two relief recesses can be provided, in which case the idler rollers would then include a correspondingly larger number of circumferential tapers and/or would be implemented with a larger number of sets of track rollers.

What is claimed is:

1. A chain drawing machine for continuous drawing of drawing stock, comprising:

at least two driveable drive chains associated with a common drawing path, a plurality of drawing members connected with each of the drive chains, with the drawing members having on one side a clamping shoe that can be pressed against the drawing stock, and on another side a sliding surface, a fixed roller guide associated with each driving chain, a plurality of rotating load-bearing idler rollers moveable on the fixed roller guide for supporting the idler rollers on the sliding surface, and a plurality of guide elements that travel with the idler rollers, wherein at least one of the sliding surface and the roller guide is formed as a segmented contact surface, with the idler rollers interacting with the segmented contact surface and being guided at the height of the segmented contact surface only by the guide elements.

2. The chain drawing machine of claim 1, wherein the segmented contact surface of the roller guide is separated by a least one relief recess to form a plurality of guide paths, and the segmented contact surface of the sliding surface is separated by a least one relief recess to form a plurality of sliding paths.

3. The chain drawing machine of claim 2, wherein the idler rollers extend over at least two guide paths.

4. The chain drawing machine of claim 2, wherein the idler rollers include a circumferential taper associated with the relief recess.

5. The chain drawing machine of claim 4, wherein the circumferential taper allows a limited elastic bending of the idler rollers to across a width of the idler rollers.

6. The chain drawing machine of claim 2, wherein an idler roller includes two parallel guided sets of track rollers, with each guide path and sliding path being associated with one set of the track rollers.

7. The chain drawing machine of claim 6, wherein the sets of track rollers are connected with one another through roller cages.

8. The chain drawing machine of claim 6, wherein the sets of track rollers are formed as chains.

9. The chain drawing machine of claim 2, wherein the guide paths and the sliding paths are disposed opposite of one another and are uniform.

10. The chain drawing machine of claim 2, wherein the at least one relief recess separates the segmented contact surface in the center.

11. The chain drawing machine of claim 2, wherein at least one of two guide path and two sliding paths are provided.

12. The chain drawing machine of claim 2, and further comprising at least one inner guide element associated with the idler rollers and capable of absorbing laterally acting guide forces, wherein the at least one inner guide element travels with the rollers and is arranged at the height of the segmented contact surface.

13. The chain drawing machine of claim 2, and further comprising at least one inner guide element associated with the idler rollers and capable of absorbing laterally acting guide forces, wherein the at least one inner guide element is arranged between the sliding surface and the roller guide.

14. The chain drawing machine of claim 2, wherein the clamping shoes and the sliding paths are integrated with the drawing members to form a single piece.

15. The chain drawing machine of claim 2, wherein the guide paths and the sliding paths are disposed opposite of one another and have an identical width.

16. The chain drawing machine of claim 1, and further comprising a connecting bolt that connects the drawing members with one another, and at least one of a track roller and tie element arranged on the connecting bolt on both sides of the drawing members.

17. The chain drawing machine of claim 1, wherein the side having the clamping shoe and side having the sliding surface are mutually parallel.

18. The chain drawing machine of claim 1, wherein the clamping shoe and the sliding surface are integrated in the respective drawing member to form a single piece.

19. The chain drawing machine of claim 1, wherein the idler rollers are formed of at least two roller sections which are supported on a common axle.

20. The chain drawing machine of claim 19, wherein at least one spacer is provided between the at least two roller sections.

21. The chain drawing machine of claim 19, wherein the at least one spacer is a sleeve disposed on the common axle.

22. The chain drawing machine of claim 1, wherein the idler rollers are connected with one another to form a chain.

23. The chain drawing machine of claim 1, wherein the drawing stock is one of rod-shaped and tubular.

24. The chain drawing machine of claim 1, wherein the drawing stock is made of a metal.

* * * * *